US008284149B2

(12) United States Patent
Yoon et al.

(10) Patent No.: US 8,284,149 B2
(45) Date of Patent: Oct. 9, 2012

(54) GATE DRIVING CIRCUIT AND DISPLAY DEVICE HAVING THE GATE DRIVING CIRCUIT

(75) Inventors: Soo-Wan Yoon, Suwon-si (KR); Joon-Chul Goh, Hwaseong-si (KR); Chong-Chul Chai, Seoul (KR); Young-Soo Yoon, Suwon-si (KR); Sei-Hyoung Jo, Seoul (KR)

(73) Assignee: Samsung Electronics Co., Ltd. (KR)

( * ) Notice: Subject to any disclaimer, the term of this patent is extended or adjusted under 35 U.S.C. 154(b) by 509 days.

(21) Appl. No.: 12/508,054

(22) Filed: Jul. 23, 2009

(65) Prior Publication Data

US 2010/0110047 A1 May 6, 2010

(30) Foreign Application Priority Data

Oct. 30, 2008 (KR) ..... 2008-107112

(51) Int. Cl.
*G09G 3/36* (2006.01)

(52) U.S. Cl. ..... 345/100; 345/204; 345/92; 345/98; 377/64

(58) Field of Classification Search ..... 345/87, 345/98, 99, 100, 204, 205, 206, 92; 377/64–81
See application file for complete search history.

(56) References Cited

U.S. PATENT DOCUMENTS

2005/0008114 A1* 1/2005 Moon ..... 377/64
2007/0018940 A1* 1/2007 Park ..... 345/100
2008/0278467 A1* 11/2008 Hwang et al. ..... 345/205

FOREIGN PATENT DOCUMENTS

JP 2006-106320 4/2006
KR 1020060076147 A 7/2006
KR 1020070037795 A 4/2007

* cited by examiner

*Primary Examiner* — Lun-Yi Lao
*Assistant Examiner* — Tom Sheng
(74) *Attorney, Agent, or Firm* — Cantor Colburn LLP

(57) ABSTRACT

An output part outputs a high voltage of a first clock signal as a high voltage of an (m)-th gate signal ('m' is a natural number) and a low voltage in response to a high signal of an (m+1)-th gate signal outputted from an (m+1)-th stage. A first maintenance part maintains a control part of the pull-up part at a low voltage in response to an (m−1)-th node signal or an (m+1)-th node signal lower than a high signal of a second clock signal having a phase opposite to the phase of the first clock signal received from an (m−1)-th stage or the (m+1)-th stage. A second maintenance part maintains the low voltage of the (m)-th gate signal in response to the (m−1)-th node signal or the (m+1)-th node signal.

24 Claims, 8 Drawing Sheets

GATE DRIVING CIRCUIT AND DISPLAY DEVICE HAVING THE GATE DRIVING CIRCUIT

This application claims priority to Korean Patent Application No. 2008-107112, filed on Oct. 30, 2008, and all the benefits accruing therefrom under 35 U.S.C. §119, the contents of which in its entirety are herein incorporated by reference.

BACKGROUND OF THE INVENTION

1. Field of the Invention

Exemplary embodiments relate to a gate driving circuit and a display device having the gate driving circuit. More particularly, exemplary embodiments relate to a gate driving circuit for improving the reliability of driving for a long time and a display device having the gate driving circuit.

2. Description of the Related Art

Recently, to reduce manufacturing costs and the total size of a panel module for a display device, an amorphous silicon gate ("ASG") technology that includes simultaneously forming a gate driving circuit in a peripheral area of a panel, and a switching device disposed in a display area of a panel, has been applied.

Since the ASG technology includes selectively outputting a clock signal in which a phase is continuously changing to generate a gate signal, there is a problem in that noise is generated by the clock signal even when not driving. Accordingly, to minimize the noise generated when not driving, a structure including various maintenance parts has been proposed.

BRIEF SUMMARY OF THE INVENTION

It has been determined herein that the ASG structure proposed in the conventional art has not effectively controlled noise generated when the temperature of a gate driving part becomes high due to being driven for a long time, and the noise of the gate signal reduces display quality as a result.

Exemplary embodiments of the present invention provide a gate driving circuit capable of improving the reliability of driving for a long time.

Exemplary embodiments of the present invention also provide a display device having the above-mentioned gate driving circuit.

According to exemplary embodiments of the present invention, a gate driving circuit includes a plurality of stages connected to each other. The plurality of stages includes a first stage in which a start signal is coupled to an input terminal. The gate driving circuit sequentially outputs output signals of respective stages. An (m)-th stage ('m' is a natural number) of the plurality of stages includes an output, a first maintenance part and a second maintenance part. The output part outputs a high voltage of a first clock signal to a high voltage of an (m)-th gate signal and a low voltage in response to a high voltage of an (m+1)-th gate signal outputted from an (m+1)-th stage. The first maintenance part maintains a control part of the pull-up part at a low voltage in response to an (m−1)-th node signal or an (m+1)-th node signal lower than a high signal of a second clock signal having a phase opposite to a phase of the first clock signal received from an (m−1)-th stage or the (m+1)-th stage. The second maintenance part maintains the low voltage of the (m)-th gate signal in response to the (m−1)-th node signal or the (m+1)-th node signal.

According to other exemplary embodiments of the present invention, a display device includes a display panel, a source driving circuit and a gate driving circuit. The display panel includes a display area, in which gate lines and source lines are disposed, displaying an image and a peripheral area surrounding the display area. The source driving circuit outputs data signals to the source lines. The gate driving circuit is integrated in the peripheral area and includes a plurality of stages outputting gate signals to the gate lines. An (m)-th stage ('m' is a natural number) of the plurality of stages includes an output part, a first maintenance part and a second maintenance part. The output part outputs a high voltage of a first clock signal to a high voltage of an (m)-th gate signal and a low voltage in response to a high voltage of an (m+1)-th gate signal outputted from an (m+1)-th stage. The first maintenance part maintains a control part of the pull-up part at a low voltage in response to an (m−1)-th node signal or an (m+1)-th node signal lower than a high voltage of a second clock signal having a phase opposite to a phase of the first clock signal received from an (m−1)-th stage or the (m+1)-th stage. The second maintenance part maintains the low voltage of the (m)-th gate signal in response to the (m−1)-th node signal or the (m+1)-th node signal.

According to exemplary embodiments of the present invention, a low voltage of a gate signal is maintained by using a node signal that is lower than a high voltage of a clock signal during an interval maintaining a low voltage of a gate signal, so that property variation due to voltage stress may be prevented.

BRIEF DESCRIPTION OF THE DRAWINGS

The above and other features and advantages of the present invention will become more apparent by describing in detailed exemplary embodiments thereof with reference to the accompanying drawings, in which.

DETAILED DESCRIPTION OF THE INVENTION

Figure 1:
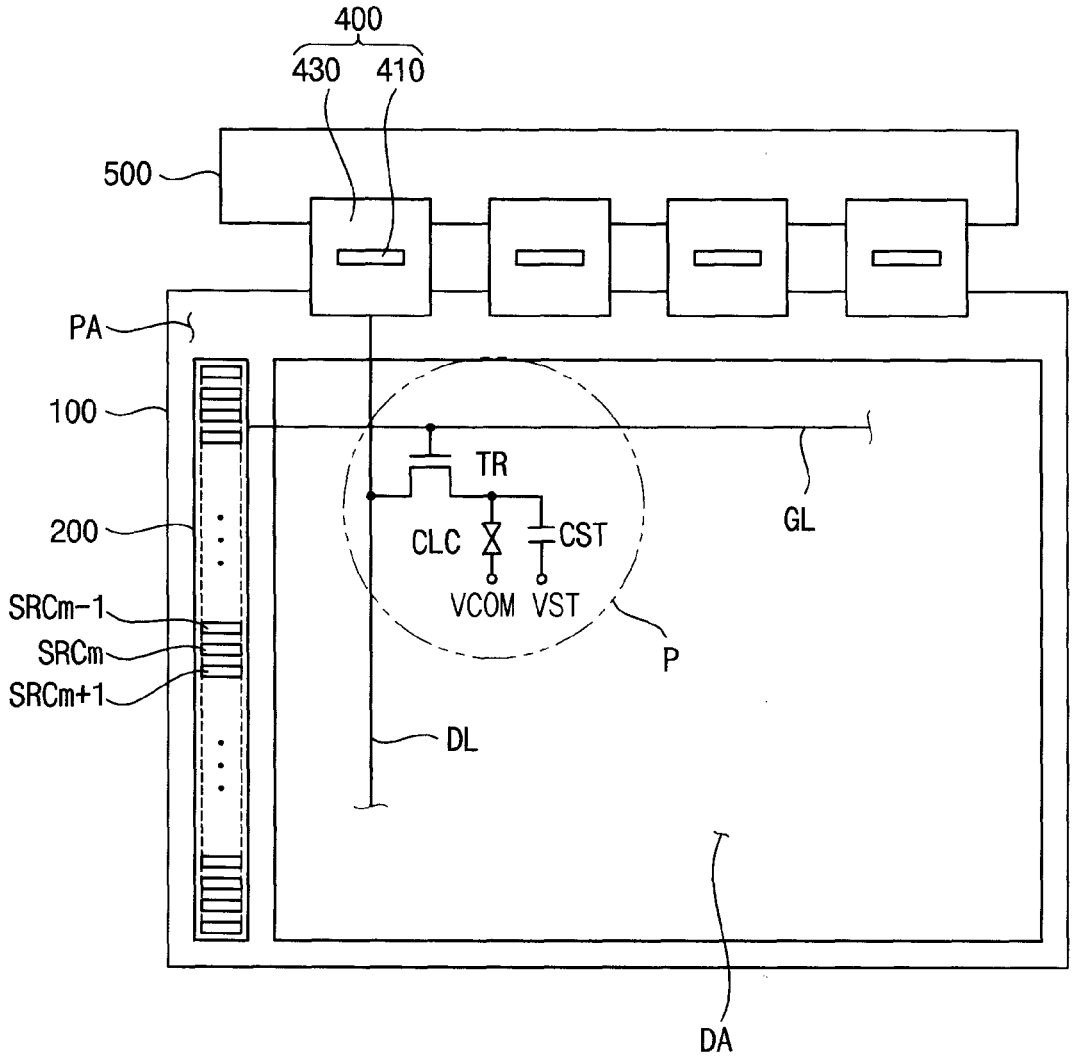
FIG. 1 is a plan view illustrating an exemplary display device according to Embodiment 1 of the present invention.

The present invention is described more fully hereinafter with reference to the accompanying drawings, in which exemplary embodiments of the present invention are shown. The present invention may, however, be embodied in many different forms and should not be construed as limited to the exemplary embodiments set forth herein. Rather, these exemplary embodiments are provided so that this disclosure will be thorough and complete, and will fully convey the scope of the present invention to those skilled in the art. In the drawings, the sizes and relative sizes of layers and regions may be exaggerated for clarity.

It will be understood that when an element or layer is referred to as being "on," "connected to" or "coupled to"

another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section described below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular exemplary embodiments only and is not intended to be limiting of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Exemplary embodiments of the invention are described herein with reference to schematic illustrations of idealized exemplary embodiments (and intermediate structures) of the present invention. As such, variations from the shapes of the illustrations as a result, for example, of manufacturing techniques and/or tolerances, are to be expected. Thus, exemplary embodiments of the present invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present invention will be described in detail with reference to the accompanying drawings.

Example Embodiment 1

FIG. 1 is a plan view illustrating an exemplary display device according to Embodiment 1 of the present invention.

Referring to FIG. 1, the display device includes a display panel 100, a gate driving circuit 200, a source driving circuit 400 and a printed circuit board (PCB) 500.

The display panel 100 includes a display area DA and a peripheral area PA surrounding the display area DA. The display area DA includes a plurality of gate lines GL, a plurality of source lines DL, also known as data lines, and a plurality of pixel parts P. Each pixel part P includes a transistor TR electrically connected to the gate lines GL and the source lines DL, a liquid crystal capacitor CLC electrically connected to the transistor TR and a storage capacitor CST connected in parallel to the liquid crystal capacitor CLC. A common voltage VCOM is applied to a common electrode of the liquid crystal capacitor CLC, and a storage common voltage VST is applied to a common electrode of the storage capacitor CST.

The gate driving circuit 200 includes a shift register sequentially outputting gate signals of a high level to the gate lines GL. The shift register includes a plurality of stages, such as SRCm−1, SRCm, SRCm+1 (where m is a natural number). The gate driving circuit 200 is preferably integrated in the peripheral area PA corresponding to one end of the gate lines GL.

The source driving circuit 400 includes a source driving chip 410 outputting data signals to the source lines DL and a flexible printed circuit board ("FPCB") 430, on which the source driving chip 410 is mounted, electrically connecting the display panel 100 with the PCB 500. Here, FIG. 1 is illustrated as an example in which the source driving chip 410 is mounted on the FPCB 430. However, in alternative exemplary embodiments, the source driving chip 410 may be directly mounted on the display panel 100, or the source driving chip 410 may be directly integrated in the peripheral area PA of the display panel 100.

Figure 2:
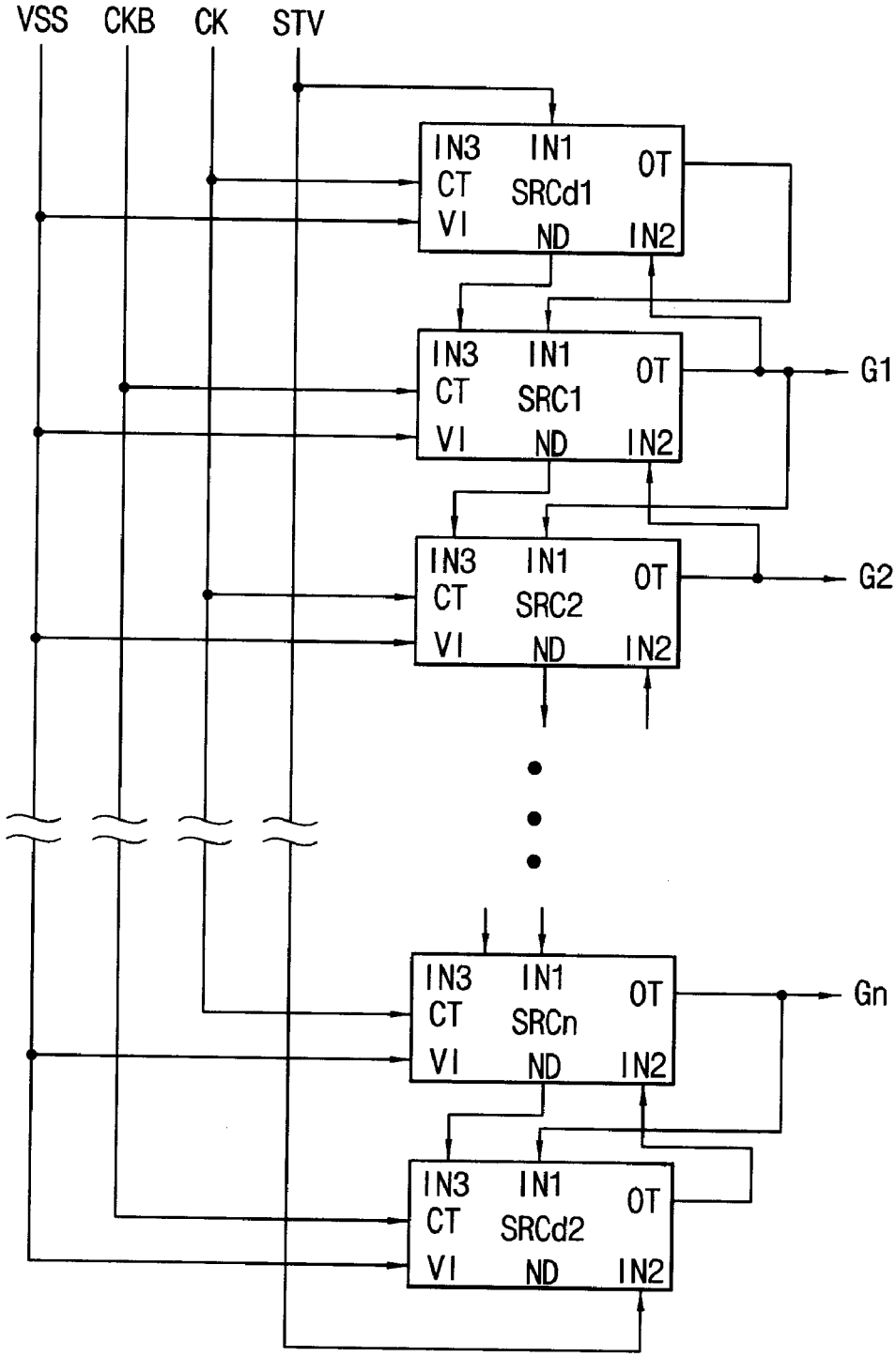
FIG. 2 is a block diagram illustrating the exemplary gate driving circuit of FIG. 1.

FIG. 2 is a block diagram illustrating an exemplary gate driving circuit of FIG. 1.

Referring to FIG. 2, the gate driving circuit 200 includes a shift register including a first stage SRC1 to an n-th stage SRCn dependently connected to each other, a first dummy stage SRCd1 and a second dummy stage SRCd2.

The first stage SRC1 to the n-th stage SRCn are connected to n gate lines GL, G1, G2, . . . , Gn, respectively, to sequentially output n gate signals to the gate lines GL. The first dummy stage SRCd1 controls the driving of the first stage SRC1, and the second dummy stage SRCd2 controls the driving of the n-th stage SRCn. The first dummy stage SRCd1 and the second dummy stage SRCd2 are not connected to the gate lines GL.

Each stage includes a clock terminal CT, a first input terminal IN1, a second input terminal IN2, a third input terminal IN3, a voltage terminal V1, a node terminal ND and an output terminal OT.

The clock terminal CT receives a first clock signal CK or a second clock signal CKB having the phase opposite to the phase of the first clock signal CK. For example, the clock terminal CT of odd-numbered stages SRCd1, SRC2, SRC4, . . . , SRCn receives the first clock signal CK, and the clock terminal CT of even-numbered stages SRC1, SRC3, . . . , SRCd2 receives the second clock signal CKB.

The first input terminal IN1 receives a vertical start signal STV or an output signal from the output terminal OT of the previous stage. For example, the first input terminal IN1 of the dummy stage SRCd1, which is the first stage in the shift register, receives the vertical start signal STV, and the first input terminals IN1 of the first stage SRC1 to the second dummy stage SRCd2 receive a gate signal of the previous stage, respectively.

A vertical start signal STV or an output signal from the output terminal OT of the next stage is provided to the second input terminal IN2. The second input terminals IN2 of the first dummy stage SRCd1 to the n-th stage SRCn receive an output signal of the next stage, respectively, and the second input terminal IN2 of the second dummy stage SRCd2 receives the vertical start signal STV. The vertical start signal STV received by the second input terminal IN2 of the second dummy stage SRCd2 may be a vertical start signal STV corresponding to the next frame.

The third input terminal IN3 receives a node signal of a certain node N, as will be described with respect to FIG. 3, from the node terminal ND of the previous stage. As the certain node N is a part connected to the clock terminal CT through a capacitor Cc, the clock signal CK or CKB is dropped by the capacitor Cc to have a node voltage of a lower level than a voltage of a high level of the clock signal CK or CKB. Also, the third input terminal IN3 may receive a node signal of a certain node N of the next stage.

The voltage terminal V1 receives a low voltage VSS. The low voltage VSS corresponds to a low level of the gate signal outputted from the stage.

The node terminal ND is connected to the certain node N to output the node signal. The node terminal ND is electrically connected to the third input terminal IN3 of the next stage to provide the node signal of the certain node N to the third input terminal IN3 of the next stage.

The output terminal OT is electrically connected to the corresponding gate line GL to output the gate signal to the gate line GL. The output terminal OT is also electrically connected to the second input terminal IN2 of the previous stage to provide the output signal to the second input terminal IN2 of the previous stage. Also, the output terminal OT is electrically connected to the first input terminal IN1 of the next stage to provide the output signal to the first input terminal IN1 of the next stage.

Figure 3:
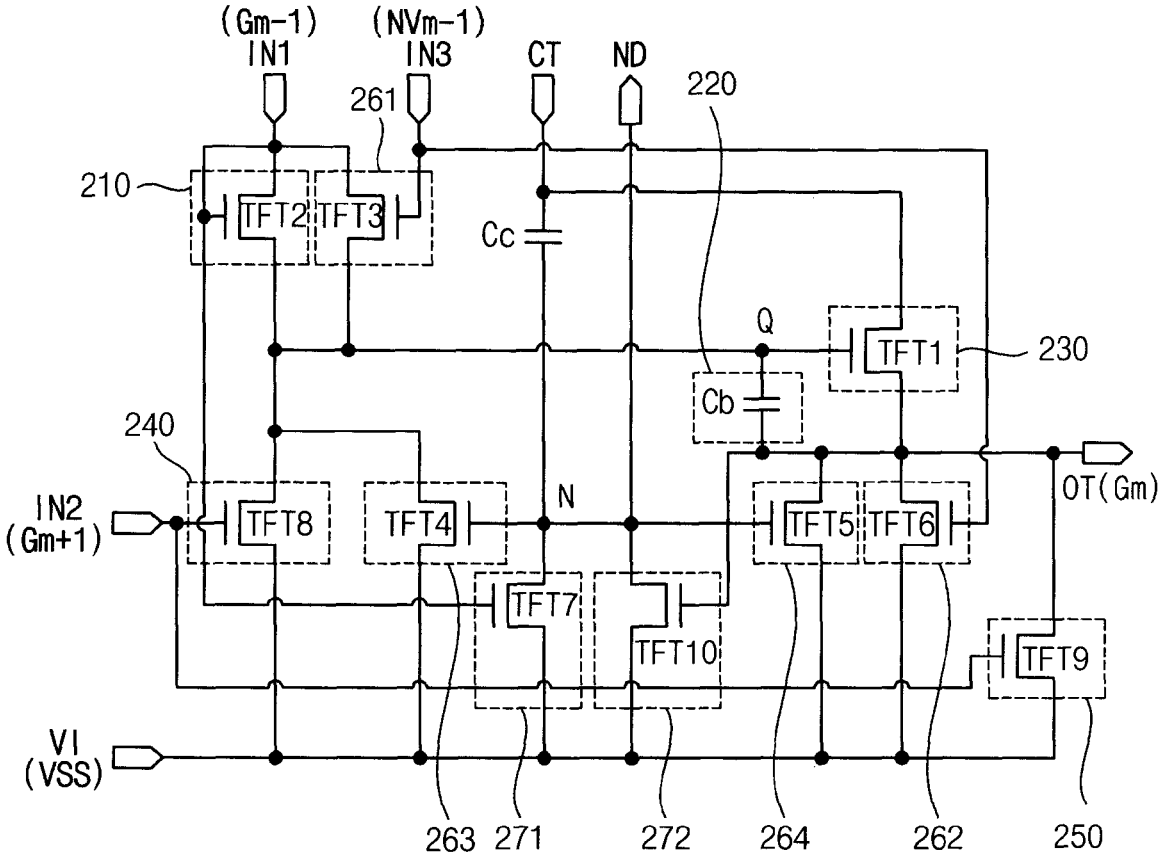
FIG. 3 is a circuit diagram illustrating an exemplary stage of FIG. 2.
Figure 4:
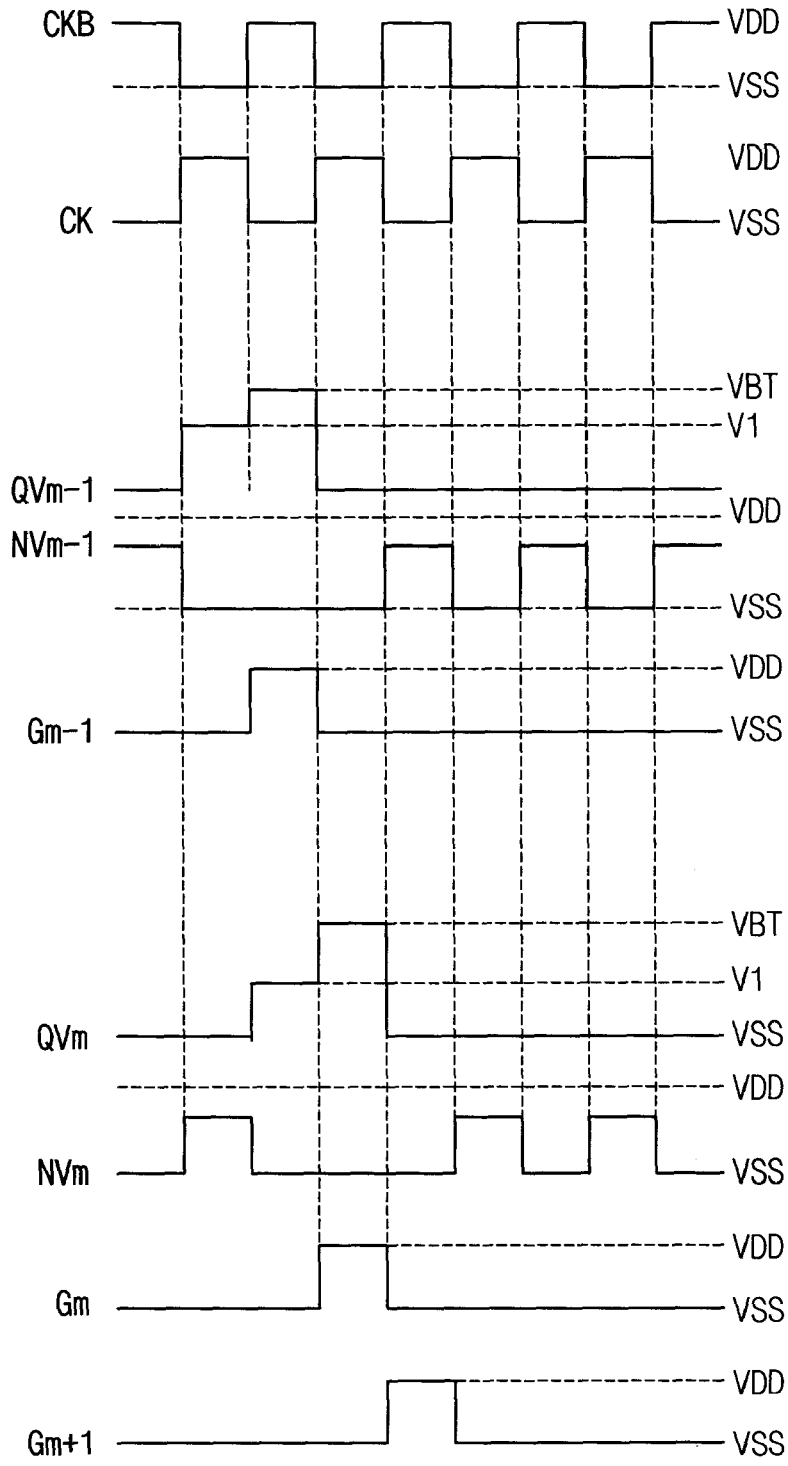
FIG. 4 is a waveform diagram illustrating input/output signals of the exemplary gate driving circuit of FIG. 3.

FIG. 3 is a circuit diagram illustrating an exemplary stage of FIG. 2. FIG. 4 is a waveform diagram illustrating input/output signals of the exemplary gate driving circuit of FIG. 3.

Referring to FIGS. 3 and 4, an (m)-th stage SRCm includes a buffer part 210, a charging part 220, a pull-up part 230, a discharging part 240, a pull-down part 250, a first maintenance part 261, a second maintenance part 262, a third maintenance part 263, a fourth maintenance part 264, a first switching part 271 and a second switching part 272.

A control part and an input part of the buffer part 210, such as a gate electrode and a source electrode of a thin film transistor ("TFT") TFT2, are connected to the first input terminal IN1, and an output part of the buffer part 210, such as a drain electrode of TFT2, is connected to the charging part 220. When a high voltage VDD of the m−1 gate signal Gm−1, an output signal of the previous stage, is received by the first input terminal IN1, the buffer part 210 outputs a first voltage V1 corresponding to the high voltage VDD. The charging part 220 charges a charge in the capacitor Cb corresponding to the first voltage V1.

A control part (Q node) of the pull-up part 230, such as a gate electrode of TFT1, is connected to the charging part 220, an input part of the pull-up part 230, such as a source electrode of TFT1, is connected to the clock terminal CT, and an output part of the pull-up part 230, such as a drain electrode of TFT1, is connected to the output terminal OT. In a state in which a first voltage V1 charged in the charging part 220 is applied to the control part (Q node) of the pull-up part 230, when a high voltage VDD of the first clock signal CK is received by the input part of the pull-up part 230, the pull-up part 230 is bootstrapped. In this case, the first voltage V1 of the control part (Q node) of the pull-up part 230 is raised to a boosting voltage VBT. The node signal QVm of the control part (Q node) of the pull-up part 230 has the first voltage V1 at the (m−1)-th section (Tm−1) and the boosting voltage VBT at the (m)-th section (Tm). When the boosting voltage VBT is applied to the control part of the pull-up part 230, the pull-up part 230 outputs the high voltage VDD of the first clock signal CK at the high voltage of the (m)-th gate signal Gm.

A control part of the discharging part 240, such as a gate electrode of TFT3, is connected to the second input terminal IN2, an input part of the discharging part 240, such as a source electrode of TFT3, is connected to the control part (Q node) of the pull-up part 230, and an output part of the discharging part 240, such as a drain electrode of TFT3, is connected to the voltage terminal V1. The discharging part 240 discharges a voltage applied to the control part (Q node) of the pull-up part 230 to the low voltage VSS, when the high voltage VDD of the (m+1)-th gate signal Gm+1, which is the output signal of the next stage, is received by the second input terminal IN2.

A control part of the pull-down part 250, such as a gate electrode of TFT9, is connected to the second input terminal IN2, an input part of the pull-down part 250, such as a source electrode of TFT9, is connected to the output terminal OT, and an output part of the pull-down part 250, such as a drain electrode of TFT9, is connected to the voltage terminal V1. When the high voltage VDD of the (m+1)-th gate signal Gm+1 is received, the pull-down part 250 pulls down the high voltage VDD of the output terminal OT to the low voltage VSS.

A control part of the first maintenance part 261, such as a gate electrode of TFT3, is connected to the third input terminal IN3, an input part of the first maintenance part 261, such as a source electrode of TFT3, is connected, to the first input terminal IN1, and an output part of the first maintenance part 261, such as a drain electrode of TFT3, is connected to the control part (Q node) of the pull-up part 230. When an (m−1)-th node signal NVm−1 applied to a certain node (N node) of the previous stage is received by the third input terminal 1N3 of the present stage, the first maintenance part 261 maintains a voltage applied to the control part (Q node) of the pull-up part 230 at the low voltage VSS of the (m−1)-th gate signal Gm−1, which is the output signal of the previous stage. The (m−1)-th node signal NVm−1 is a lower voltage than the high voltage VDD, as a voltage of a level that the high voltage VDD of the second clock signal CKB applied to the previous stage is dropped by a capacitor Cc.

A control part of the second maintenance part 262, such as a gate electrode of TFT6, is connected to the third input terminal IN3, an input part of the second maintenance part 262, such as a source electrode of TFT6, is connected to the output terminal OT, and an output part of the second maintenance part 262, such as a drain electrode of TFT6, is connected to the voltage terminal V1. When the (m−1)-th node signal NVm−1 is received by the third input terminal IN3, the second maintenance part 262 maintains a voltage of the output terminal OT at the low voltage VSS.

The first maintenance part 261 and the second maintenance part 262 maintain voltages of the control part (Q node) of the pull-up part 230 and the output terminal OT at the low voltage VSS, respectively, in response to the (m−1)-th node signal NVm−1 of the previous stage. The (m−1)-th node signal NVm−1 and the (m+1)-th node signal NVm+1 are synchronized to the second clock signal CKB, so the first maintenance part 261 and the second maintenance part 262 could maintain voltages of the control part (Q node) of the pull-up part 230 and the output terminal OT at the low voltage VSS, respectively, in response to the (m+1)-th node signal NVm+1 of the next stage.

A control part of the first switching part 271, such as a gate electrode of TFT7, is connected to the first input terminal IN1, an input part of the first switching part 271, such as a source electrode of TFT7, is electrically connected to the clock terminal CT, and an output part of the first switching part 271, such as a drain electrode of TFT7, is connected to the voltage terminal V1. The capacitor Cc is connected between the clock terminal CT and the input part of the first switching part 271. That is, the input part of the first switching part 271 is connected to the certain node (N node). When the high voltage VDD of the (m−1)-th gate signal Gm−1 is applied, the switching part 271 discharges the (m)-th node signal NVm to the low voltage VSS.

A control part of the third maintenance part 263, such as a gate electrode of TFT4, is connected to the input part of the first switching part 271, an input part of the third maintenance part 263, such as a source electrode of TFT4, is connected to the control part (Q node) of the pull-up part 230, and an output part of the third maintenance part 263, such as a drain electrode of TFT4, is connected to the voltage terminal V1. When the switching part 271 is turned on, the low voltage VSS is applied to the control part of the third maintenance part 263 to turn off the third maintenance part 263. Otherwise, when the first switching part 271 is turned off, the (m)-th node signal NVm is applied to the control part of the third maintenance part 263 to turn on the third maintenance part 263. When the third maintenance part 263 is turned on, the third maintenance part 263 maintains the voltage applied to the control part (Q node) of the pull-up part 230 at the low voltage VSS.

A control part of the second switching part 272, such as a gate electrode of TFT10, is connected to the output terminal OT, an input part of the second switching part 272, such as a source electrode of TFT10, is connected to the certain node N node, and an output part of the second switching part 272, such as a drain electrode of TFT10, is connected to the voltage terminal V1. When the output terminal OT outputs the high voltage VDD of the (m)-th gate signal Gm, the second switching part 272 discharges the (m)-th node signal NVm to the low voltage VSS.

A control part of the fourth maintenance part 264, such as a gate electrode of TFT5, is connected to the input part of the second switching part 272, an input part of the fourth maintenance part 264, such as a source electrode of TFT5, is connected to the output terminal OT, and an output part of the fourth maintenance part 264, such as a drain electrode of TFT5, is connected to the voltage terminal V1. When the second switching part 272 is turned on, the low voltage VSS is applied to the control part of the fourth maintenance part 264 to turn off the fourth maintenance part 264. Otherwise, when the second switching part 272 is turned off, the (m)-th node signal NVm is applied to the control part of the fourth maintenance part 264 to turn on the fourth maintenance part 264. When the fourth maintenance part 264 is turned on, the fourth maintenance part 264 maintains the voltage applied to the output terminal OT at the low voltage VSS.

The first switching part 271 and the second switching part 272 switch operations of the third maintenance part 263 and the fourth maintenance part 264 to maintain voltages of the control part (Q node) of the pull-up part 230 and the output terminal OT at the low voltage VSS.

Similarly, an (m−1)-th node signal NDm−1 or an (m+1)-th node signal NDm+1 driven by the second clock signal CKB is applied to the control part of the first maintenance part 261 and the second maintenance part 262 maintaining the (m)-th gate signal Gm of the (m)-th stage SRCm at the low voltage VSS, using the second clock signal CKB, so that the above-mentioned may prevent the first maintenance part 261 and the second maintenance part 262 from deteriorating when driven for a long time. The (m−1)-th node signal NDm−1 or the (m+1)-th node signal NDm+1 have voltages that are dropped lower than the high voltage VDD of the second clock signal CKB.

Also, the voltages dropped lower than the high voltage VDD of the first clock signal CK are applied to the control part of the third maintenance part 263 and the fourth maintenance part 264 maintaining the (m)-th gate signal Gm of the (m)-th stage SRCm at the low voltage VSS using the first clock signal CK, so that the above-mentioned may prevent the third maintenance part 263 and the fourth maintenance part 264 from deteriorating when driven for a long time.

Figure 5A:
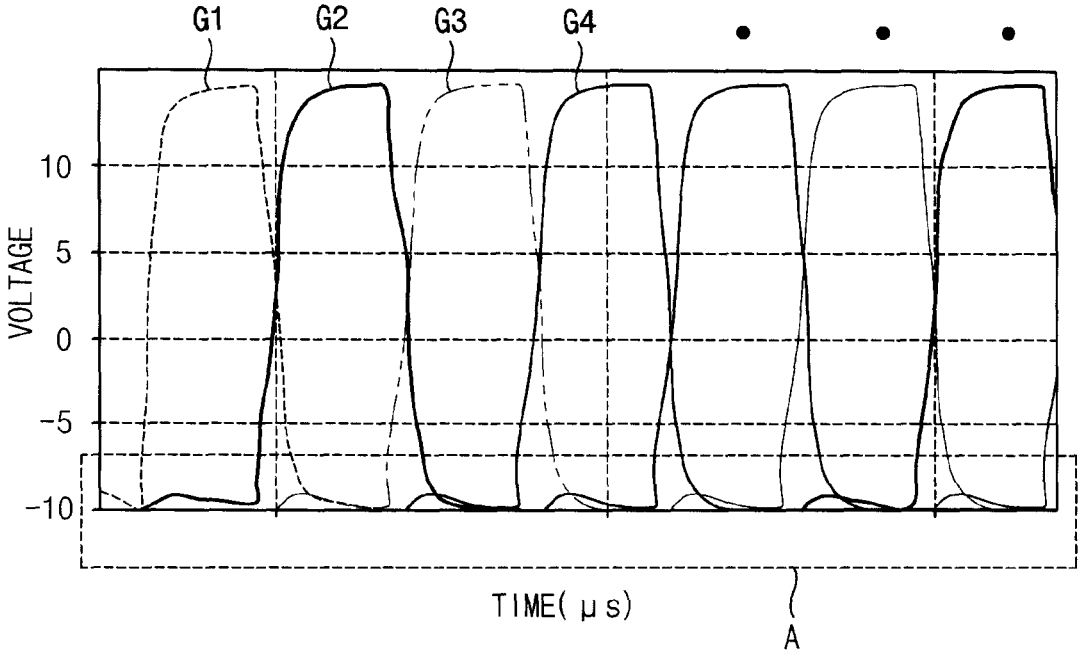
FIGS. 5A and 5B are waveform diagrams illustrating gate signals according to Embodiment 1 of the present invention.
Figure 5B:
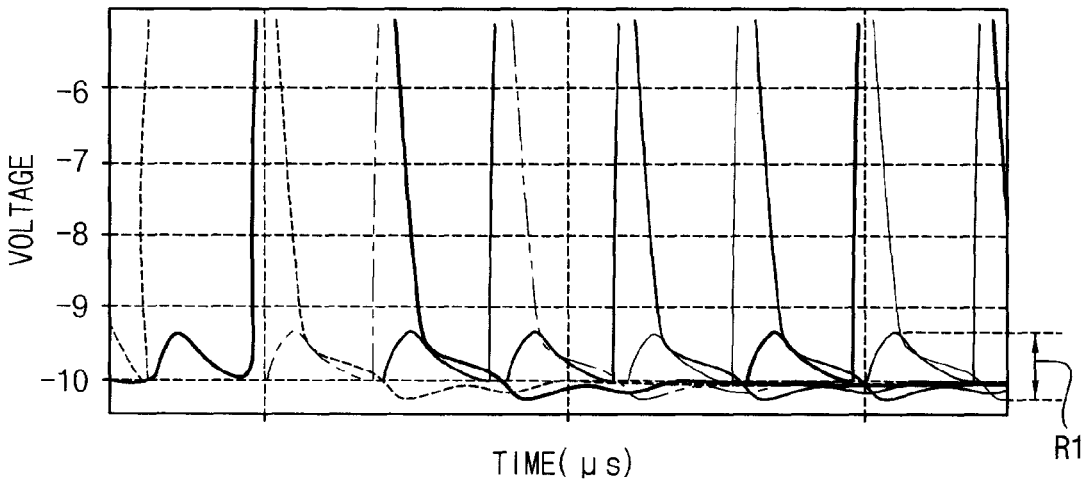
Figure 6A:
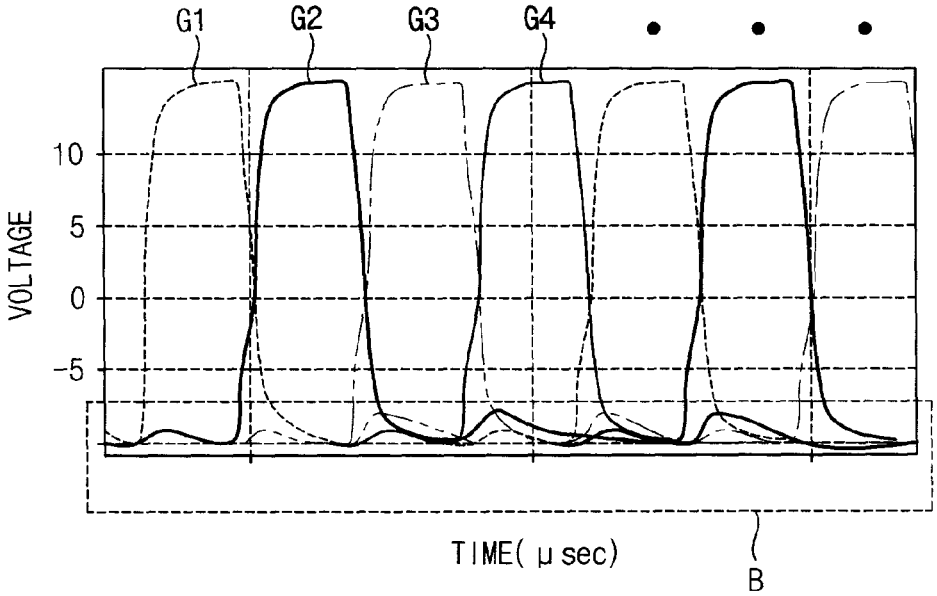
FIGS. 6A and 6B are waveform diagrams illustrating gate signals according to a comparative example.
Figure 6B:
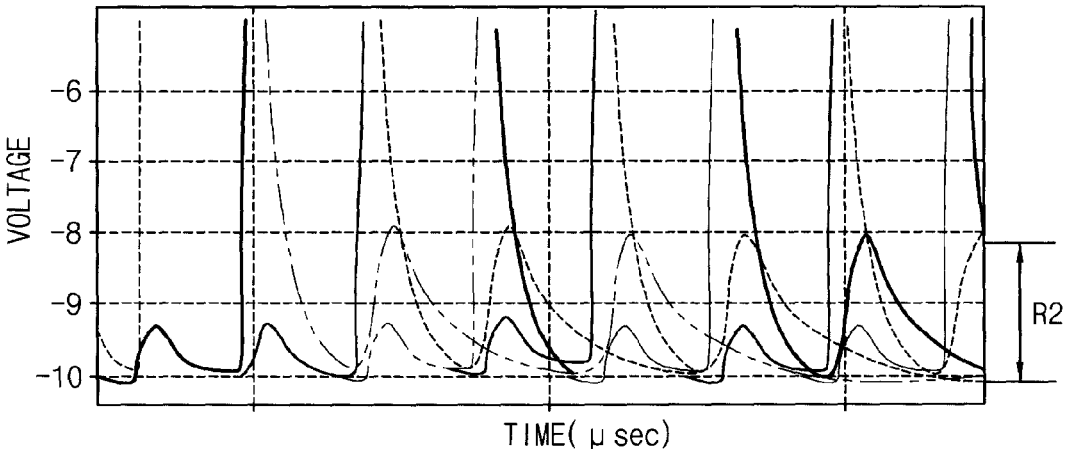

FIGS. 5A and 5B are waveform diagrams illustrating gate signals according to Embodiment 1 of the present invention. FIGS. 6A and 6B are waveform diagrams illustrating gate signals according to a comparative example.

FIG. 5A, such as Embodiment 1, is a waveform diagram of gate signals when a signal, including a dropped clock signal by a capacitor Cc, is applied to a first maintenance part to a fourth maintenance part and FIG. 5B is an enlarged diagram of part A of FIG. 5A. FIG. 6A is a waveform diagram of the gate signal when the clock signal is directly applied to the first maintenance part to the fourth maintenance part, and FIG. 6B is an enlarged diagram of part B of FIG. 6A.

Comparing FIG. 5B with FIG. 6B, it can be seen that the size of ripple components R1 of gate signals according to Embodiment 1, which are maintained at a low voltage, is significantly smaller than the size of ripple components R2 of gate signals according to the comparative example. That is, the driving reliability of a gate driving circuit according to Embodiment 1 may be improved.

Accordingly, the voltage lower than the high voltage of the clock signal is applied to the first maintenance part to the fourth maintenance part, to prevent the first maintenance part to the fourth maintenance part from deteriorating when the maintenance parts are driven for a long time.

Example Embodiment 2

Figure 7:
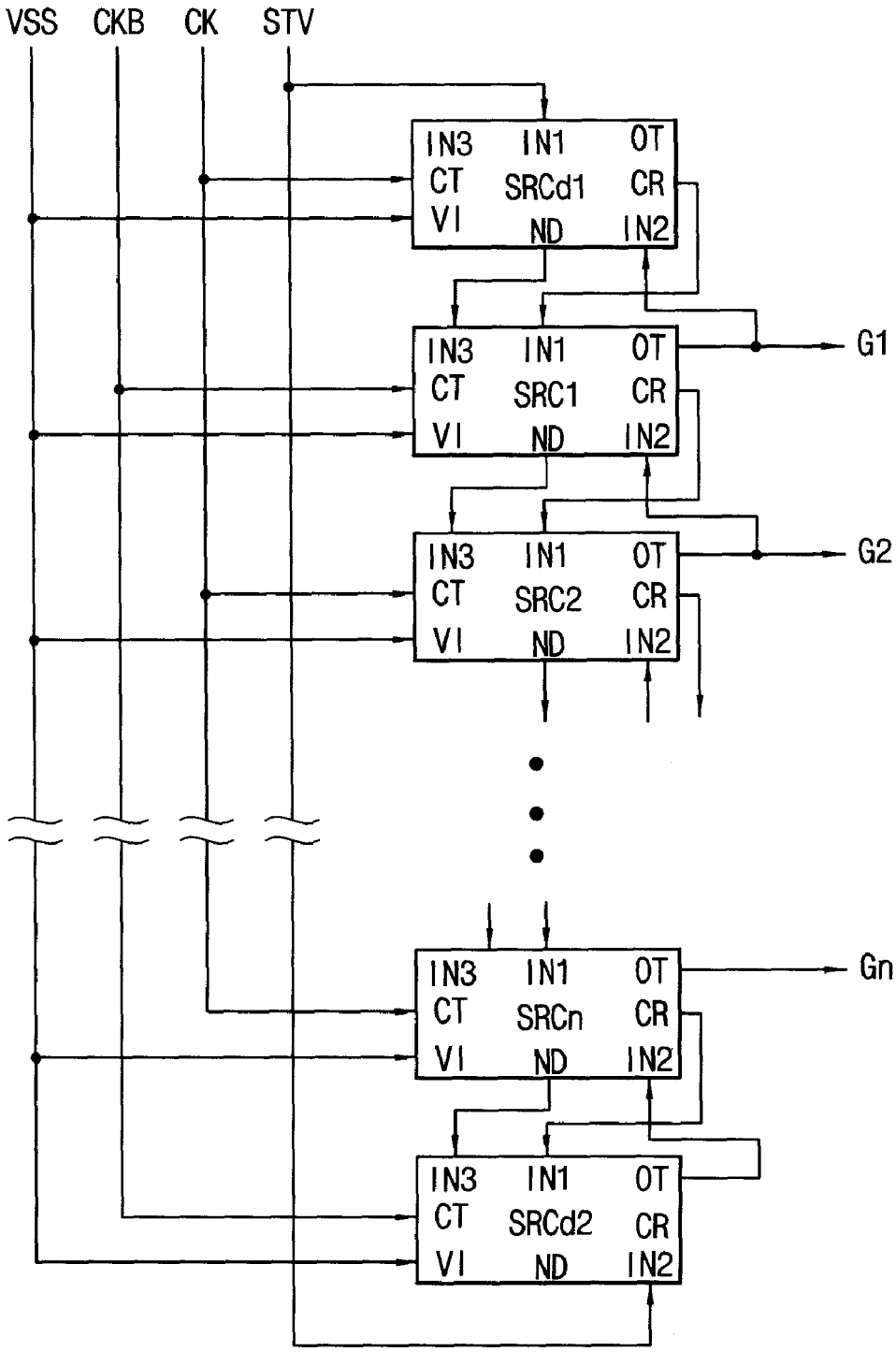
FIG. 7 is a block diagram illustrating an exemplary gate driving circuit according to Embodiment 2 of the present invention.

FIG. 7 is a block diagram illustrating an exemplary gate driving circuit according to Embodiment 2 of the present invention.

Referring to FIG. 7, the gate driving circuit includes the first stage SRC1 to the n-th stage SRCn dependently connected to each other and a shift register including the first dummy stage SRCd1 and the second dummy stage SRCd2.

The first stage SRC1 to the n-th stage SRCn are connected to n gate lines G1 to Gn, respectively, so that the stages sequentially output n gate signals to the gate lines. The first dummy stage SRCd1 controls the driving operation of the first stage SRC1, and the second dummy stage SRCd2 controls the driving operation of the n-th stage SRCn. The first dummy stage SRCd1 and the second dummy stage SRCd2 are not connected to the gate lines.

Each of the stages includes a clock terminal CT, a first input terminal IN1, a second input terminal IN2, a third input terminal IN3, a voltage terminal V1, a carry terminal CR, a node terminal ND and an output terminal OT.

The first input terminal IN1 receives a vertical start signal STV or a carry signal from the carry terminal CR of the previous stage. For example, the first input terminal IN1 of a first dummy stage SRCd1, a first stage, receives the vertical start signal STV, and the first input terminal IN1 of a first stage SRC1 to a second dummy stage SRCd2 receives the carry signal of the previous stage, respectively. The carry terminal CR is connected to the first input terminal IN1 of the next stage.

Since the clock terminal CT, the second input terminal IN2, the third input terminal IN3, the voltage terminal V1, the node terminal ND and the output terminal OT have substantially the same configurations and functions as those of Embodiment 1, a detailed explanation is omitted.

Figure 8:
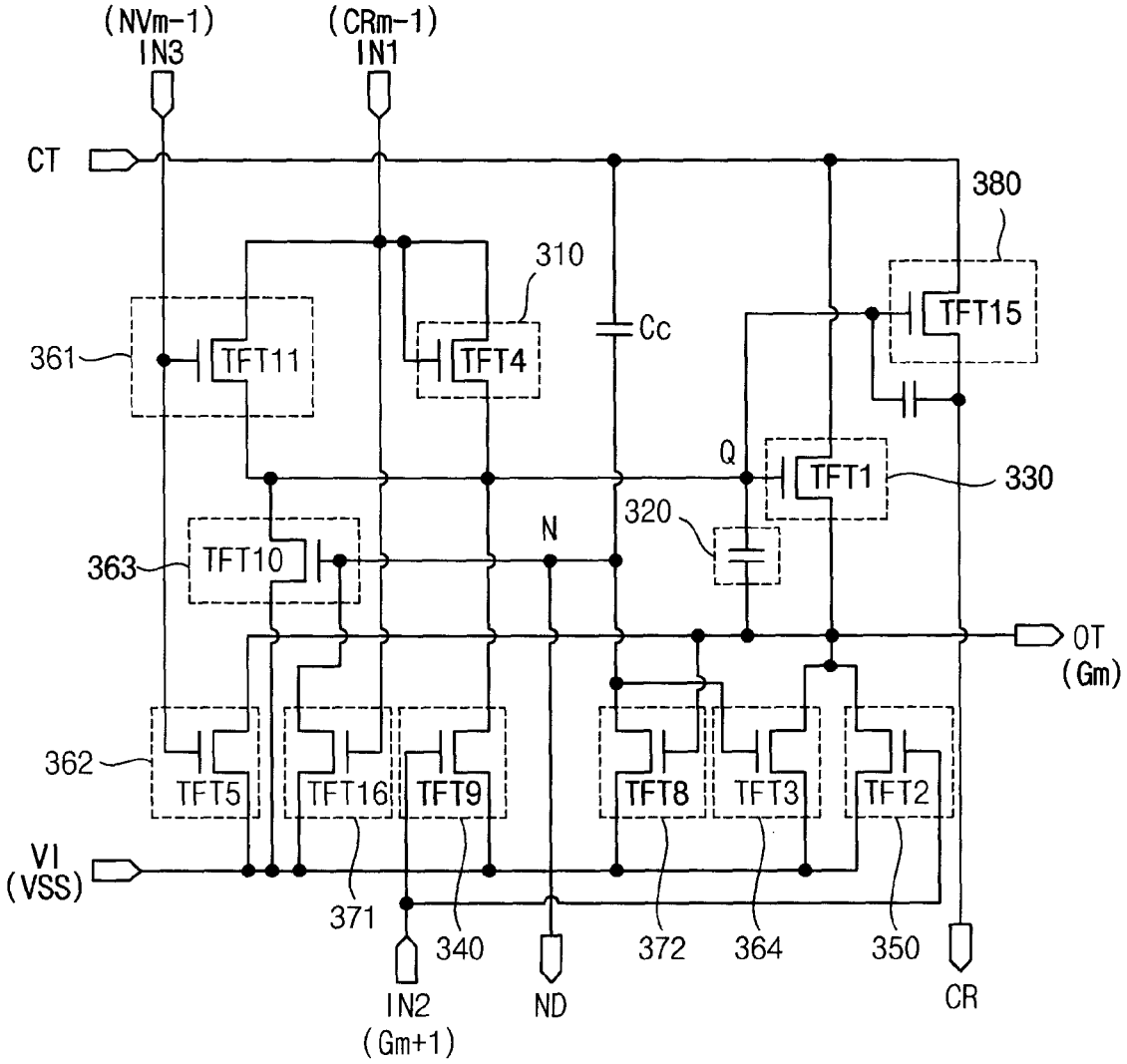
FIG. 8 is a detailed circuit diagram referring to an exemplary stage of FIG. 7.

FIG. 8 is a circuit diagram referring to an exemplary stage of FIG. 7.

Referring to FIGS. 4 to 8, the (m)-th stage includes a buffer part 310, a charging part 320, a pull-up part 330, a discharging part 340, a pull-down part 350, a first maintenance part 361, a second maintenance part 362, a third maintenance part 363, a fourth maintenance part 364, a first switching part 371, a second switching part 372 and a carry part 380.

A control part and an input part of the buffer part 310, such as a gate electrode and a source electrode of TFT4 of the buffer part 310, are connected to the first input terminal IN1, an output part of the buffer part 310, such as a drain electrode of TFT4 of the buffer part 310, is connected to the charging part 320. When a high voltage VDD of an (m−1)-th carry signal Gm−1 of the previous stage is received by the first input terminal IN1, the buffer part 310 outputs a first voltage V1 corresponding to the high voltage VDD. The charging part 320 charges a charge corresponding to the first voltage V1.

A control part (Q node) of the pull-up part 330, such as a gate electrode of TFT1 of pull-up part 330, is connected to the charging part 320, an input part of the pull-up part 330, such as a source electrode of TFT1 of pull-up part 330, is connected to the clock terminal CT, and an output part of the pull-up part 330, such as a drain electrode of TFT1 of pull-up part 330, is connected to the output terminal OT. In a state in which the charged first voltage V1 is applied to the control part (Q node) of the pull-up part 330, the pull-up part 330 is bootstrapped when the high voltage VDD of the first clock signal CK is received. Here, the first voltage V1 of the control part (Q node) of the pull-up part 330 is boosted to a boosting voltage VBT. A node signal QVm of the control part (Q node) of the pull-up part 330 has the first voltage V1 in an (m−1)-th section Tm−1, and has the boosting voltage VBT in an (m)-th section Tm. When the boosting voltage VBT is applied to the control part of the pull-up part 330, the pull-up part 330 outputs the high voltage VDD of the first clock signal CK with the high voltage of the (m)-th gate signal Gm.

A control part of the discharging part 340, such as a gate electrode of TFT9 of discharging part 340, is connected to the second input terminal IN2, an input part of the discharging part 340, such as a source electrode of TFT9 of discharging part 340, is connected to the control part (Q node) of the pull-up part 330, and an output part of the discharging part 340, such as a drain electrode of TFT9 of discharging part 340, is connected to the voltage terminal V1. The discharging part 340 discharges a voltage applied to the control part (Q node) of the pull-up part 330 to the low voltage VSS, when a high voltage VDD of an (m+1)-th gate signal Gm+1, an output signal of the next stage, is received by the second input terminal IN2.

A control part of the pull-down part 350, such as a gate electrode of TFT2 of the pull-down part 350, is connected to the second input terminal IN2, an input part of the pull-down part 350, such as a source electrode of TFT2 of pull-down part 350, is connected to the output terminal OT, and an output part, such as a drain electrode of TFT2 of pull-down part 350, is connected to the voltage terminal V1. The pull-down part 350 pulls down the high voltage VDD of the output terminal OT at the low voltage VSS when the high voltage VDD of the (m+1)-th gate signal is received by the second input terminal IN2.

A control part of the first maintenance part 361, such as a gate electrode of TFT11, is connected to the third input terminal IN3, an input part of the first maintenance part 361, such as a source electrode of TFT11, is connected to the first input terminal IN1, and an output part of the first maintenance part 361, such as a drain electrode of TFT11, is connected to the control part (Q node) of the pull-up part 330. The first maintenance part 361 maintains a voltage applied to the control part (Q node) of the pull-up part 330 at a low voltage VSS of an (m−1)-th carry signal CRm−1 of the previous stage, when an (m−1)-th node signal NVm−1 applied to a certain node (N node) of the previous stage is received. The (m−1)-th node signal NVm−1 has a voltage of a level that the high voltage VDD of the second clock signal CKB applied to the previous stage is dropped by a capacitor Cc, the voltage is a voltage lower than the high voltage VDD. The level of the (m−1)-th node signal NVm−1 may be variously set up, by controlling the capacitance of the capacitor Cc.

A control part of the second maintenance part 362, such as a gate electrode of TFT5 of second maintenance part 362, is connected to the third input terminal IN3, an input part, such as a source electrode of TFT5 of the second maintenance part 362, is connected to the output terminal OT, and an output part, such as a drain electrode of TFT5 of the second maintenance part 362, is connected to the voltage terminal V1. The second maintenance part 362 maintains the voltage of the output terminal OT at the low voltage VSS when the (m−1)-th node signal NVm−1 is received by the third input terminal IN3.

The first maintenance part 361 and the second maintenance part 362 maintain the voltages of the control part (Q node) of the pull-up part 330 and the output terminal OT at the low voltage VSS in response to an (m−1)-th node signal NVm−1 of the previous stage. The (m−1)-th node signal NVm−1 is synchronized to the second clock signal CKB.

A control part of the first switching part 371, such as a gate electrode of TFT16, is connected to the first input terminal IN1, an input part of the first switching part 371, such as a source electrode of TFT16, is electrically connected to the clock terminal CT, and an output terminal of the first switching part 371, such as a drain electrode of TFT16, is connected to the voltage terminal V1. The capacitor Cc is connected between the clock terminal CT and the input part of the switching part 371. That is, the input part of the first switching part 371 is connected to a certain node (N node). The first switching part 371 discharges the (m)-th node signal NVm to the low voltage VSS when the high voltage VDD of the (m−1) gate signal Gm−1 is applied to the first input terminal IN1.

A control part of the third maintenance part 363, such as a gate electrode of TFT10, is connected to the input part of the first switching part 371, an input part of the third maintenance part 363, such as a source electrode of TFT10, is connected to the control part (Q node) of the pull-up part 330, and an output part of the third maintenance part 363, such as a drain electrode of TFT10, is connected to the voltage terminal V1. When the first switching part 371 is turned on to apply the low voltage VSS to the control part of the third maintenance part 363, the third maintenance part 363 is turned off. However, when the first switching part 371 is turned off to apply the (m)-th node signal NVm to the control part of the third maintenance part 363, the third maintenance part 363 is turned on. When the third maintenance part 363 is turned on, the third maintenance part 363 maintains the voltage applied to the control part (Q node) of the pull-up part 330 at the low voltage VSS.

A control part of the second switching part 372, such as a gate electrode of TFT8 of second switching part 372, is connected to the output terminal OT, an input part of the second switching part 372, such as a source electrode of TFT8 of second switching part 372, is connected to the certain node (N node), and an output part of the second switching part 372, such as a drain electrode of TFT8 of second switching part 372, is connected to the voltage terminal V1. The second switching part 372 discharges the (m)-th node signal NVm to the low voltage VSS, when the output terminal OT outputs the high voltage VDD of the (m)-th gate signal Gm.

A control part of the fourth maintenance part 364, such as a gate electrode of TFT3 of the fourth maintenance part 364, is connected to the input part of the second switching part 372, an input part of the fourth maintenance part 364, such as a source electrode of TFT3 of the fourth maintenance part 364, is connected the output terminal OT, and an output part of the fourth maintenance part 364, such as a drain electrode of TFT3 of the fourth maintenance part 364, is connected to the voltage terminal V1. When the second switching part 372 is turned on to apply the low voltage VSS to the control part of the fourth maintenance part 364, the fourth maintenance part 364 is turned off. However, when the second switching part 372 is turned off to apply the (m)-th node signal NVm to the control part of the fourth maintenance part 364, the fourth maintenance pat 364 is turned on. When the fourth maintenance part 364 is turned on, the fourth maintenance part 364 maintains the voltage applied to the output terminal OT at the low voltage VSS.

The first switching part 371 and the second switching part 372 switch operations of the third maintenance part 363 and the fourth maintenance part 364, to maintain the voltages of the control part (Q node) of the pull-up part 330 and the output terminal OT at the low voltage VSS, respectively.

A control part of the carry part 380, such as a gate electrode of TFT15, is connected to the control part (Q node) of the pull-up part 330, an input part of the carry part 380, such as a source electrode of TFT15, is connected to the clock terminal CT, and an output part of the carry part 380, such as a drain electrode of TFT15, is connected to the carry terminal CR. The carry part 380 outputs the high voltage VDD of the first clock signal CK in response to the voltage applied to the control part (Q node) of the pull-up part 330. The control part (Q node) of the pull-up part 300 has the first voltage V1 in the (m−1)-th section Tm−1, and has the boosting voltage VBT in the (m)-th section Tm. For example, the (m)-th carry signal may have a pulse width corresponding to an (m−1)-th section Tm−1 and the (m)-th section Tm, or may have a pulse width corresponding to the (m)-th section Tm.

Similarly, the (m−1)-th node signal NDm−1 or the (m+1)-th node signal ND+1 of a certain node (N node) of the previous stage SRCm−1 or the next stage SRCm+1 driven by the second clock signal CKB is applied to the control parts of the first maintenance part 361 and the second maintenance part 362 maintaining the (m)-th gate signal Gm of the (m)-th stage SRCm at the low voltage VSS, using the second clock signal CKB, so the first maintenance part 361 and the second maintenance part 362 may be prevented from deteriorating when driven for a long time. The (m−1)-th node signal NDm−1 or the (m+1)-th node signal NDm+1 has the voltages dropped lower than the high voltage VDD of the second clock signal CKB.

Also, the voltage dropped lower than the high voltage VDD of the first clock signal CK is applied to the control parts of the third maintenance part 363 and the fourth maintenance part 364 maintaining the (m)-th gate signal Gm of the (m)-th stage SRCm at the low voltage VSS, using the first clock signal CK, so that third maintenance part 363 and the fourth maintenance part 364 may be prevented from deteriorating when driven for a long time.

According to embodiments of the present invention, maintenance parts maintaining a level of a gate signal at a low level are operated with a signal of a level lower than a clock signal, so that voltage stress on the maintenance parts may be prevented. Accordingly, the driving reliability of gate signals, which are output signals of a gate driving circuit, may be improved.

The foregoing is illustrative of the present invention and is not to be construed as limiting thereof. Although a few exemplary embodiments of the present invention have been described, those skilled in the art will readily appreciate that many modifications are possible in the exemplary embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific exemplary embodiments disclosed, and that modifications to the disclosed exemplary embodiments, as well as other exemplary embodiments, are intended to be included within the scope of the appended claims. The present invention is defined by the following claims, with equivalents of the claims to be included therein.

What is claimed is:

1. A gate driving circuit including a plurality of stages connected to each other, the plurality of stages having a first stage in which a start signal is coupled to an input terminal, the gate driving circuit sequentially outputting output signals of respective stages, an (m)-th stage ('m' is a natural number) of the plurality of stages comprising:

an output part outputting a high voltage of a first clock signal as a high voltage of an (m)-th gate signal and a low voltage in response to a high voltage of an (m+1)-th gate signal outputted from an (m+1)-th stage;

a first maintenance part maintaining a control part of a pull-up part at a low voltage in response to an (m−1)-th node signal or an (m+1)-th node signal lower than a high voltage of a second clock signal having a phase opposite to a phase of the first clock signal received from an (m−1)-th stage or the (m+1)-th stage; and a second maintenance part maintaining an output node of the output part at -the low voltage of the (m)-th gate signal in response to the (m−1)-th node signal or the (m+1)-th node signal, wherein the control parts of the first and second maintenance parts are gate electrodes and the two gate electrodes are directly connected.

2. The gate driving circuit of claim 1, wherein the output part comprises:

the pull-up part outputting a high voltage of a first clock signal as a high voltage of an (m)-th gate signal; and a pull-down part pulling down the high voltage of the (m)-th gate signal to a low voltage in response to a high voltage of an (m+1)-th gate signal outputted from an (m+1)-th stage.

3. The gate driving circuit of claim 1, wherein the (m)-th stage further comprises:

a third maintenance part maintaining the control part of the pull-up part at the low voltage in response to an (m)-th node signal lower than the high voltage of the first clock signal; and a fourth maintenance part maintaining the low voltage of the (m)-th gate signal in response to the (m)-th node signal.

4. The gate driving circuit of claim 3, wherein the third maintenance part comprises a control part connected to a clock terminal receiving the first clock signal and a capacitor, an input part connected to the control part of the pull-up part, and an output part connected to a voltage terminal receiving the low voltage; and the fourth maintenance part comprises a control part connected to the clock terminal receiving the first clock signal and the capacitor, an input part connected to an output terminal outputting the (m)-th gate signal, and an output part connected to the voltage terminal.

5. The gate driving circuit of claim 1, wherein the first maintenance part comprises the control part connected to a third input terminal receiving the (m−1)-th node signal or the (m+1)-th node signal, an output part connected to the control part of the pull-up part, and an input part connected to a first input terminal receiving a signal outputted from the (m−1)-th stage; and the second maintenance part comprises the control part connected to the third input terminal, an input part connected to an output terminal, and an output part connected to a voltage terminal.

6. The gate driving circuit of claim 5, wherein the (m)-th stage further comprises:

a charging part comprising a first end connected to the control part of the pull-up part and a second end connected to the output terminal outputting the (m)-th gate signal;

a buffer part comprising a control part and an input part connected to the first input terminal, and an output part connected to the first end of the charging part;

a discharging part comprising a control part connected to a second input terminal receiving the (m+1)-th gate signal of the (m+1)-th stage, an input part connected to the control part of the pull-up part, and an output part connected to the voltage terminal;

a first switching part comprising a control part connected to the first input terminal, an input part connected to the control part of the third maintenance part, and an output part connected to the voltage terminal; and a second switching part comprising a control part connected to the output terminal, an input part connected to the control part of the fourth maintenance part, and an output part connected to the voltage terminal.

7. The gate driving circuit of claim 6, wherein the first switching part is turned on in an (m−1)-th section of a frame receiving a high voltage of an (m−1)-th gate signal to turn off the third maintenance part, and the second switching part is turned on in an (m)-th section of the frame outputting a high voltage of the (m)-th gate signal to turn off the fourth maintenance part, and the first switching part and the second switching part are turned off in remaining sections of the frame excluding the (m)-th section and the (m−1)-th section of the frame receiving a low voltage of the (m−1)-th gate signal and the (m)-th gate signal to turn on the third maintenance part and the fourth maintenance part.

8. The gate driving circuit of claim 6, wherein the (m)-th stage further comprises a carry part outputting the first clock signal with an (m)-th carry signal in response to a voltage of the control part of the pull-up part.

9. The gate driving circuit of claim 8, wherein the first input terminal receives an (m−1)-th carry signal of the (m−1)-th stage.

10. The gate driving circuit of claim 9, wherein the first switching part is turned on in an (m−1)-th section of a frame receiving a high voltage of the (m−1)-th carry signal to turn off the third maintenance part, and the second switching part is turned on in an (m)-th section of the frame outputting a high voltage of the (m)-th gate signal to turn off the fourth maintenance part, and the first switching part and the second switching part are turned off in remaining sections of the frame excluding the (m)-th section and the (m−1)-th section of the frame receiving a low voltage of the (m−1)-th carry signal and the (m)-th gate signal to turn on the third maintenance part and the fourth maintenance part.

11. A display device comprising:

a display panel including a display area displaying an image, the display area including gate lines and source lines, and a peripheral area surrounding the display area;

a source driving circuit outputting data signals to the source lines; and a gate driving circuit integrated in the peripheral area and including a plurality of stages outputting gate signals to the gate lines, an (m)-th stage ('m' is a natural number) of the plurality of stages comprising:

an output part outputting a high voltage of a first clock signal as a high voltage of an (m)-th gate signal and a low voltage in response to a high voltage of an (m+1)-th gate signal outputted from an (m+1)-th stage;

a first maintenance part maintaining a control part of a pull-up part at the low voltage in response to an (m−1)-th node signal or an (m+1)-th node signal lower than a high voltage of a second clock signal having a phase opposite to a phase of the first clock signal received from an (m−1)-th stage or the (m+1)-th stage; and a second maintenance part maintaining the low voltage of the (m)-th gate signal in response to the (m−1)-th node signal or the (m+1)-th node signal, wherein the control parts of the first and second maintenance parts are gate electrodes and the two gate electrodes are directly connected.

12. The display device of claim 11, wherein the output part comprises:

the pull-up part outputting a high voltage of a first clock signal at a high voltage of an (m)-th gate signal; and a pull-down part pulling down the high voltage of the (m)-th gate signal to a low voltage in response to a high voltage of an (m+1)-th gate signal outputted from an (m+1)-th stage.

13. The display device of claim 11, wherein the (m)-th stage further comprises:

a third maintenance part maintaining the control part of the pull-up part at the low voltage in response to an (m)-th node signal lower than the high voltage of the first clock signal; and a fourth maintenance part maintaining the low voltage of the (m)-th gate signal in response to the (m)-th node signal.

14. The display device of claim 13, wherein the third maintenance part comprises a control part connected to a clock terminal receiving the first clock signal and a capacitor, an input part connected to the control part of the pull-up part, and an output part connected to a voltage terminal receiving the low voltage; and the fourth maintenance part comprises a control part connected to the clock terminal receiving the first clock signal and the capacitor, an input part connected to an output terminal outputting the (m)-th gate signal, and an output part connected to the voltage terminal.

15. The display device of claim 11, wherein the first maintenance part comprises the control part connected to a third input terminal receiving the (m−1)-th node signal or the (m+1)-th node signal, an output part connected to the control part of the pull-up part, and an input part connected to a first input terminal receiving a signal outputted from the (m−1)-th stage; and the second maintenance part comprises the control part connected to the third input terminal, an input part connected to an output terminal, and an output part connected to a voltage terminal.

16. The display device of claim 15, wherein the (m)-th stage further comprises:

a charging part comprising a first terminal connected to the control part of the pull-up part and a second terminal connected to an output terminal outputting the (m)-th gate signal;

a buffer part comprising a control part and an input part that are connected to the first input terminal, and an output part connected to the first terminal of the charging part;

a discharging part comprising a control part connected to a second input terminal receiving the (m+1)-th gate signal of the (m+1)-th stage, an input part connected to, the control part of the pull-up part, and an output part connected to the voltage terminal;

a first switching part comprising a control part connected to the first input terminal, an input part connected to the control part of the third maintenance part, and an output part connected to the voltage terminal; and a second switching part comprising a control part connected to the output terminal, an input part connected to a control part of the fourth maintenance part, and an output part connected to the voltage terminal.

17. The display device of claim 16, wherein the first switching part is turned on in an (m−1)-th section of a frame receiving a high voltage of an (m−1)-th gate signal to turn off the third maintenance part, and the second switching part is turned on in an (m)-th section of the frame outputting a high voltage of the (m)-th gate signal to turn off the fourth maintenance part, and the first switching part and the second switching part are turned off in remaining sections of the frame excluding the (m)-th section and the (m−1)-th section of the frame receiving a low voltage of the (m−1)-th gate signal and the (m)-th gate signal to turn on the third maintenance part and the fourth maintenance part.

18. The display device of claim 16, wherein the (m)-th stage further comprises:

a carry part outputting the first clock signal with an (m)-th carry signal in response to a voltage of the control part of the pull-up part.

19. The display device of claim 18, wherein the first input terminal receives an (m−1)-th carry signal of the (m−1)-th stage.

20. The display device of claim 19, wherein the first switching part is turned on in an (m−1)-th section of a frame receiving a high voltage of the (m−1)-th carry signal to turn off the third maintenance part, and the second switching part is turned on in an (m)-th section of the frame outputting a high voltage of the (m)-th gate signal to turn off the fourth maintenance part, and the first switching part and the second switching part are turned off in remaining sections of the frame excluding the (m)-th section and the (m−1)-th section of the frame receiving a low voltage of the (m−1)-th carry signal and the (m)-th gate signal to turn on the third maintenance part and the fourth maintenance part.

21. A gate driving circuit including a plurality of stages connected to each other, the plurality of stages having a first stage in which a start signal is coupled to an input terminal, the gate driving circuit sequentially outputting output signals of respective stages, an (m)-th stage ('m' is a natural number) of the plurality of stages comprising:

an output part outputting a high voltage of a first clock signal as a high voltage of an (m)-th gate signal and a low voltage in response to a high voltage of an (m+1)-th gate signal outputted from an (m+1)-th stage;

a first maintenance part maintaining a control part of a pull-up part at a low voltage in response to an (m−1)-th node signal or an (m+1)-th node signal lower than a high voltage of a second clock signal having a phase opposite to a phase of the first clock signal received from an (m−1)-th stage or the (m+1)-th stage; and a second maintenance part maintaining an output node of the output part at the low voltage of the (m)-th gate signal in response to the (m−1)-th node signal or the (m+1)-th node signal, wherein the (m)-th stage further comprises:

a third maintenance part maintaining the control part of the pull-up part at the low voltage in response to an (m)-th node signal lower than the high voltage of the first clock signal; and a fourth maintenance part maintaining the low voltage of the (m)-th gate signal in response to the (m)-th node signal.

22. The gate driving circuit of claim 21, wherein the third maintenance part comprises a control part connected to a clock terminal receiving the first clock signal and a capacitor, an input part connected to the control part of the pull-up part, and an output part connected to a voltage terminal receiving the low voltage; and the fourth maintenance part comprises a control part connected to the clock terminal receiving the first clock signal and the capacitor, an input part connected to an output terminal outputting the (m)-th gate signal, and an output part connected to the voltage terminal.

23. A display device comprising:

a display panel including a display area displaying an image, the display area including gate lines and source lines, and a peripheral area surrounding the display area;

a source driving circuit outputting data signals to the source lines; and a gate driving circuit integrated in the peripheral area and including a plurality of stages outputting gate signals to the gate lines, an (m)-th stage ('m' is a natural number) of the plurality of stages comprising:

an output part outputting a high voltage of a first clock signal as a high voltage of an (m)-th gate signal and a low voltage in response to a high voltage of an (m+1)-th gate signal outputted from an (m+1)-th stage;

a first maintenance part maintaining a control part of a pull-up part at the low voltage in response to an (m−1)-th node signal or an (m+1)-th node signal lower than a high voltage of a second clock signal having a phase opposite to a phase of the first clock signal received from an (m−1)-th stage or the (m+1)-th stage; and a second maintenance part maintaining the low voltage of the (m)-th gate signal in response to the (m−1)-th node signal or the (m+1)-th node signal, wherein the (m)-th stage further comprises:

a third maintenance part maintaining the control part of the pull-up part at the low voltage in response to an (m)-th node signal lower than the high voltage of the clock signal; and a fourth maintenance part maintaining the low voltage of the (m)-th gate signal in response to the (m)-th node signal.

24. The display device of claim 23, wherein the third maintenance part comprises a control part connected to a clock terminal receiving the first clock signal and a capacitor, an input part connected to the control part of the pull-up part, and an output part connected to a voltage terminal receiving the low voltage; and the fourth maintenance part comprises a control part connected to the clock terminal receiving the first clock signal and the capacitor, an input part connected to an output terminal outputting the (m)-th gate signal, and an output part connected to the voltage terminal.

* * * * *